US005498185A

United States Patent [19]

Knudsen et al.

[11] Patent Number: 5,498,185

[45] Date of Patent: Mar. 12, 1996

[54] METHODS OF MAKING AN IMPROVED X-RAY TUBE CATHODE CUP ASSEMBLY

[75] Inventors: Bruce A. Knudsen, Amsterdam, N.Y.; Clyde L. Briant, Barrington, R.I.

[73] Assignee: General Electric Company, Schenectady, N.Y.

[21] Appl. No.: 311,988

[22] Filed: Sep. 26, 1994

[51] Int. Cl.[6] ..... H01J 9/02; H01J 9/18

[52] U.S. Cl. ..... 445/28; 445/29

[58] Field of Search ..... 445/28, 29, 32

[56] References Cited

U.S. PATENT DOCUMENTS 3,194,625 7/1965 Danko ..... 445/32

FOREIGN PATENT DOCUMENTS 55-166840 12/1980 Japan ..... 445/44
2-260353 10/1990 Japan ..... 445/28
5-314894 11/1993 Japan ..... 445/28

*Primary Examiner*—Samuel M. Heinrich
*Assistant Examiner*—Jeffrey T. Knapp
*Attorney, Agent, or Firm*—R. Thomas Payne; James Magee, Jr.

[57] ABSTRACT

A method of making a high performance x-ray system having an improved cathode cup assembly reduces tube manufacturing costs and failures due to filament misalignment during the manufacturing process.

5 Claims, 4 Drawing Sheets

METHODS OF MAKING AN IMPROVED X-RAY TUBE CATHODE CUP ASSEMBLY

This application is related to commonly assigned U.S. patent application Ser. No. 08/299,166 (RD-23,413) of Knudsen et al., filed Aug. 22, 1994, and U.S. patent application Ser. No. 08/299,165 (RD-23,859) of Knudsen et al , filed Aug. 22, 1994, U.S. patent application Ser. No. 08/311,989 (RD-23,704) of Knudsen et al. , filed simultaneously herewith, each of which is expressly incorporated herein by reference.

BACKGROUND OF THE INVENTION

The present invention relates to methods of making diagnostic and therapeutic radiology equipment and more particularly, to improved methods for making cathode assemblies used in x-ray generating equipment, such as computerized axial tomography (C.A.T.) scanners. More particularly, the invention is directed to methods for making improved x-ray tube cathode cup assemblies including a solid, one piece insulator member.

Each x-ray tube is normally enclosed in an oil-filled protective casing. A glass envelope contains a cathode plate, a rotating disk target and a rotor that is part of a motor assembly that spins the target. A stator is provided outside the tube proximate to the rotor and overlapping therewith about two-thirds of the rotor length. The glass envelope is enclosed in an oil-filled lead casing having a window for the x-rays that are generated to escape the tube. The casing in some x-ray tubes may include an expansion vessel, such as a bellows.

X-rays are produced when, in a vacuum, electrons are released, accelerated and then abruptly stopped. This takes place in the x-ray tube. To release electrons, the filament in the cathode is heated to incandescence (white heat) by passing an electric current through it. The electrons are accelerated by a high voltage (ranging from about ten thousand to in excess of hundreds of thousands of volts) between the anode (positive) and the cathode (negative) and impinge on the anode, whereby they are abruptly slowed down. The anode, usually referred to as the target, is often of the rotating disc type, so that the electron beam is constantly striking a different point on the anode perimeter. The x-ray tube itself is made of glass, but is enclosed in a protective casing that is filled with oil to absorb the heat produced. High voltages for operating the tube are supplied by a transformer. The alternating current is rectified by means of rectifier tubes (or "valves") in some cases by means of barrier-layered rectifiers.

For therapeutic purposes—e.g., the treatment of tumors, etc.—the x-rays employed are in some cases generated at much higher voltages (over 4,000,000 volts). Also, the rays emitted by radium and artificial radiotropics, as well as electrons, neutrons and other high speed particles (for instance produced by a betatron), are used in radio therapy.

X-ray tube performance can be affected by the alignment of the filament in the cathode assembly. Specifically, during x-ray tube manufacturing, it is important to be able to initially align the filament and have it stay aligned during completion of the manufacturing cycle and during operation of the x-ray tube.

Previously, coiled tungsten filaments used in x-ray tubes were assembled and then aligned in the cathode cup. Once assembled, the filaments were heated to about 2800° C. to produce the desired microstructure. During this heating, when assembled in the cathode cup, many filaments sagged and thus move out of alignment making it necessary to reseat them in the cathode cup and repeat the flashing or the heating to 2800° C. In some instances, this step had to be repeated up to as many as five (5) times until the filament alignment in the cathode cup was obtained with the desired microstructure.

In the prior method of positioning the insulators in the cathode cup, prior to inserting the filaments in the insulators, an operator would cut each insulator flange according to a predetermined patterned which was dependent upon whether the x-ray tube was a single, double, triple, etc. filament x-ray tube. The resulting flange may, depending on the particular tube receiving the cathode cup, have developed burs as a result of the cutting process. These burs often resulted in the insulation being twisted or misaligned when the insulation flange was connected, such as by welding, to the surface of the cathode cup. Misalignment of the insulation in the cathode cup has resulted in filament misalignment.

Because a misaligned insulator could produce a misaligned filament thereby causing increased manufacturing costs, the need for new methods which provide properly aligned coiled tungsten filament(s) in the x-ray tube cathode cup became apparent. Thus, there is a need for a new method of assembling a one-piece insulator made of, for example, a ceramic material fixed on the cathode cup that is sized to slide into the cathode cup in a position such that the apertures formed in the one-piece insulator and the cathode cup are in proper alignment thereby resulting in proper alignment of the filament. The method should desirably provide for assembly of a one-piece unit and the cathode cup such that the resulting cathode has at least one filament with proper alignment upon completion of the manufacturing process.

SUMMARY OF THE INVENTION

In carrying out the present invention in preferred forms thereof, we provide new methods of making an insulator assembly for cathode cups and improved methods for manufacturing an x-ray cathode assembly for use in x-ray tubes, such as those incorporated in diagnostic and therapeutic radiology machines, for example, computer tomography scanners. Illustrated embodiments of the x-ray cathode assembly including the cup having the insulator assembly housing the filament made by the methods disclosed herein, are shown as an x-ray system having an x-ray tube, an x-ray tube and a insulated cup/cathode assembly.

In accordance with one aspect of the present invention there is provided a method for making a cathode assembly for an x-ray system having an x-ray tube therein comprising the steps of: providing an insulator structure having apertures formed therein; providing a cathode cup structure having apertures therein; operatively connecting the insulating structure to the cathode cup structure so that the apertures of one are aligned with the aperture of the other; positioning at least one filament in the combination insulation structure/cathode cup structure; and securing the at least one filament in the combination insulation structure/cathode cup structure such that the filament is properly aligned.

Another aspect of the present invention includes a method of making an insulator for assembly in the cathode cup of an x-ray tube, comprising the steps of: placing a ceramic, such as alumina or zirconia, in a mold, the mold having means for forming apertures in the ceramic material; removing the ceramic material from the mold; curing the green ceramic material; inserting a filament holding tube into each aperture, preferably made of Kovar, into the resulting cured ceramic; and operatively securing the holding tabs in position on the ceramic, the holding tabs and the ceramic are preferably connected by a metal to ceramic seal, such as by brazing.

Accordingly, an object of the present invention is to provide an improved method for making an x-ray system including an x-ray tube having a properly assembled and aligned filament in the cathode assembly cup.

A further object of the present invention is to provide an improved method of making an x-ray tube which includes an improved cathode assembly having a one-piece insulator unit.

A still further object of the present invention is to provide an improved method for assembling coiled tungsten filament(s) into the cathode assembly cup.

A further object of the present invention is to provide a method for assembling the filament into the cathode cup so that proper alignment is achieved.

Other objects and advantages of the invention will be apparent from the following description, the accompanying drawings and the appended claims.

DESCRIPTION OF THE PREFERRED EMBODIMENT

Figure 1A:
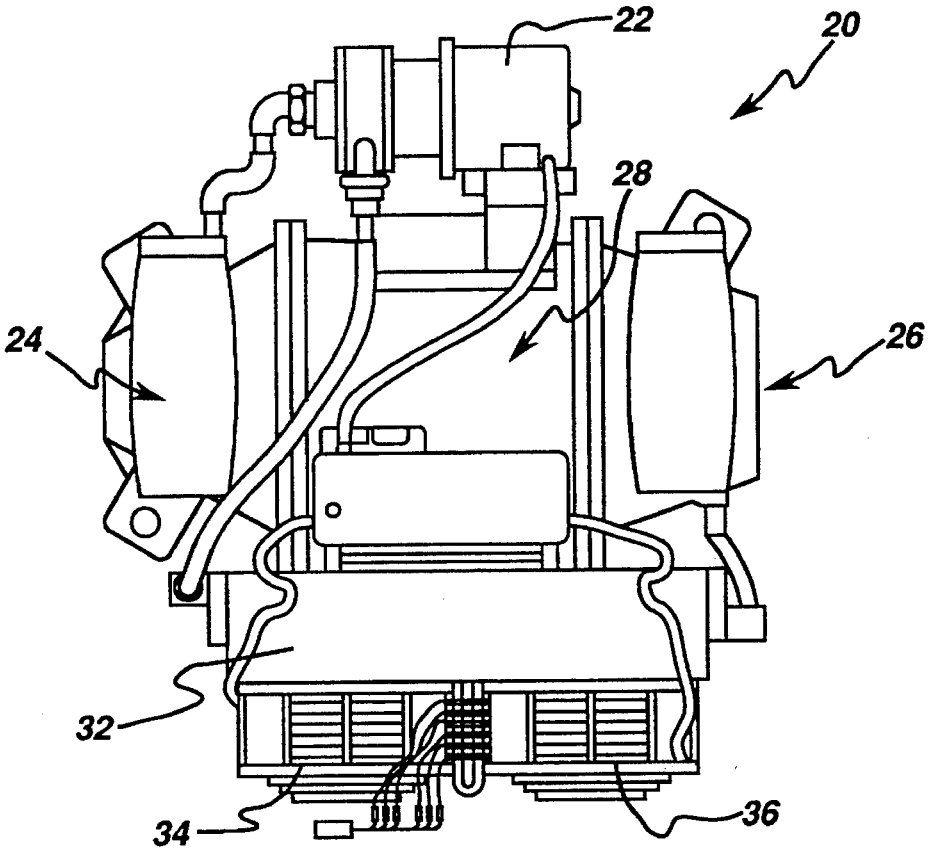
fig. 1a PRIOR ART
FIG. 1*a* is a plan view of a representative x-ray system.
Figure 1B:
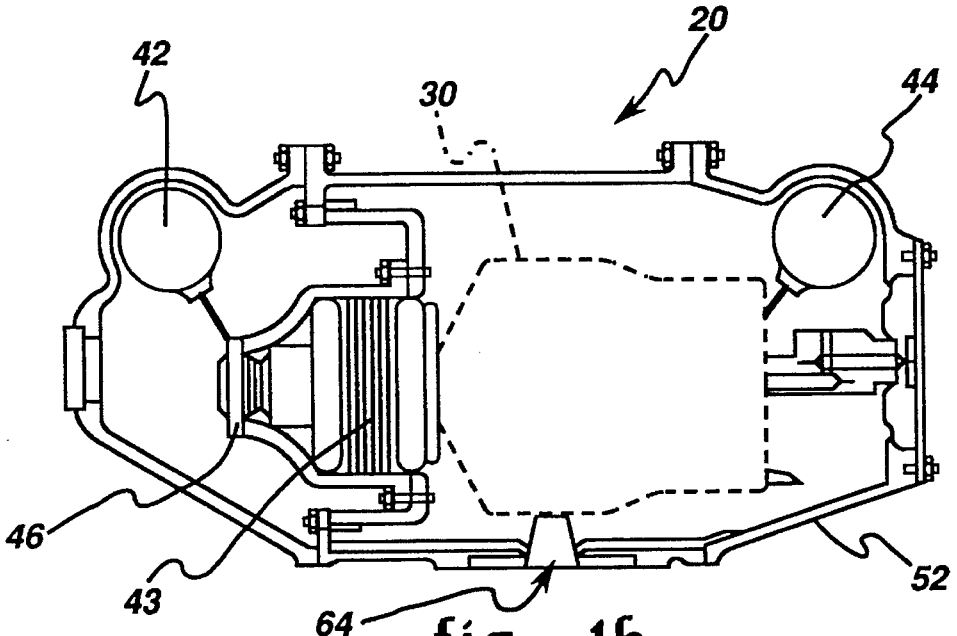
fig. 1b PRIOR ART
FIG. 1*b* is a sectional view with parts removed of the x-ray system of FIG. 1*a;*
Figure 2:
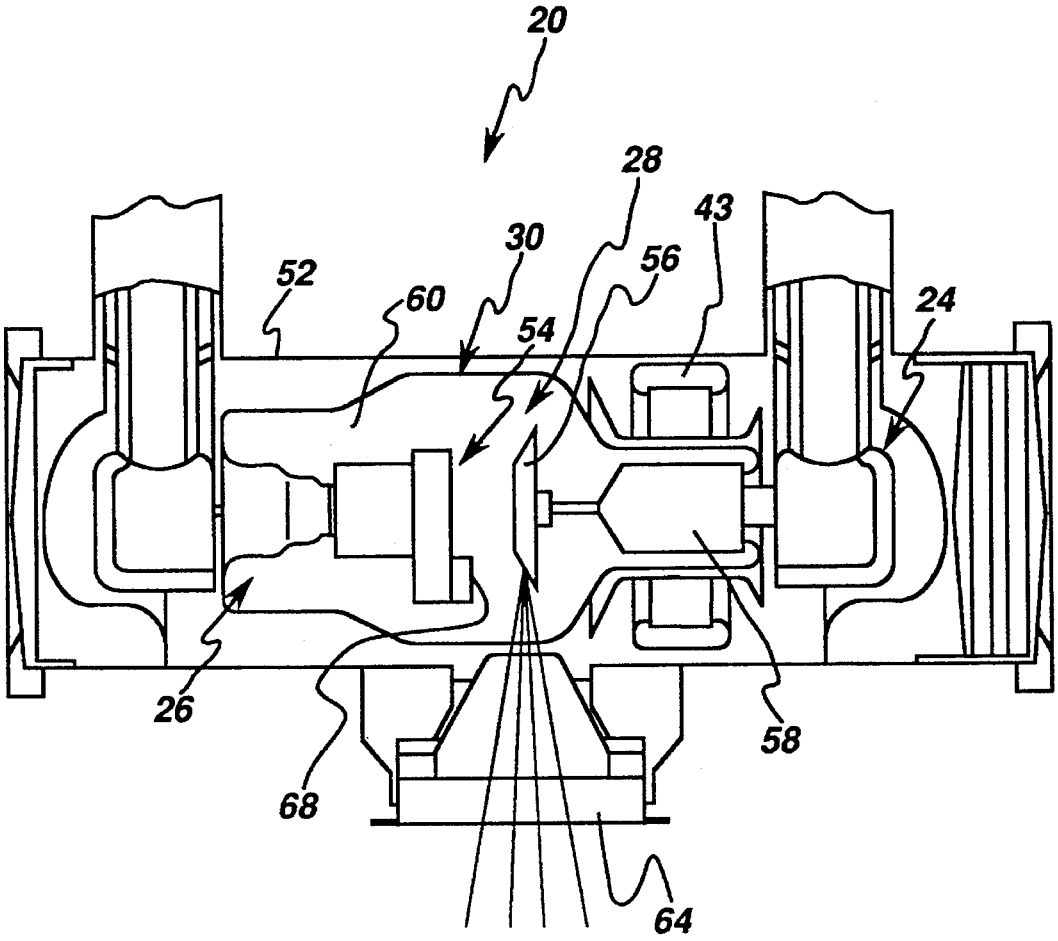
fig. 2 PRIOR ART
FIG. 2 is a schematic representation of another representative x-ray system having an x-ray tube positioned therein.

A representative x-ray system in which an x-ray tube made, in accordance with the method(s) of the present invention, by one preferred method thereof, is illustrated as generally designated by the numeral 20 in FIGS. 1*a*, 1*b* and 2. As can be seen, the system 20 comprises an oil pump 22, an anode end 24, a cathode end 26, a center section 28 positioned between the anode end and the cathode end, which contains the x-ray tube 30. A radiator 32 for cooling the oil is positioned to one side of the center section and may have fans 34 and 36 operatively connected to the radiator 32 for providing cooling air flow over the radiator as the hot oil circulates therethrough. The oil pump 22 is provided for circulating the hot oil through the system 20 and through the radiator 32, etc. As shown in FIG. 1*b*, electrical connections are provided in the anode receptacle 42 and the cathode receptacle 44.

As shown in FIG. 2, the x-ray system 20 comprises a casing 52 preferably made of aluminum and lined with lead and a cathode plate 54, a rotating target disc 56 and a rotor 58 enclosed in a glass envelope 60. A stator 43 is positioned outside the glass envelope 60 inside the lead lined casing 52 relative to the rotor 58. The casing 52 is filled with oil for cooling and high voltage insulation purposes as was explained above. A window 64 for emitting x-rays is operatively formed in the casing 52 and relative to the target disc 56 for allowing generated x-rays to exit the x-ray system 20.

Figure 3:
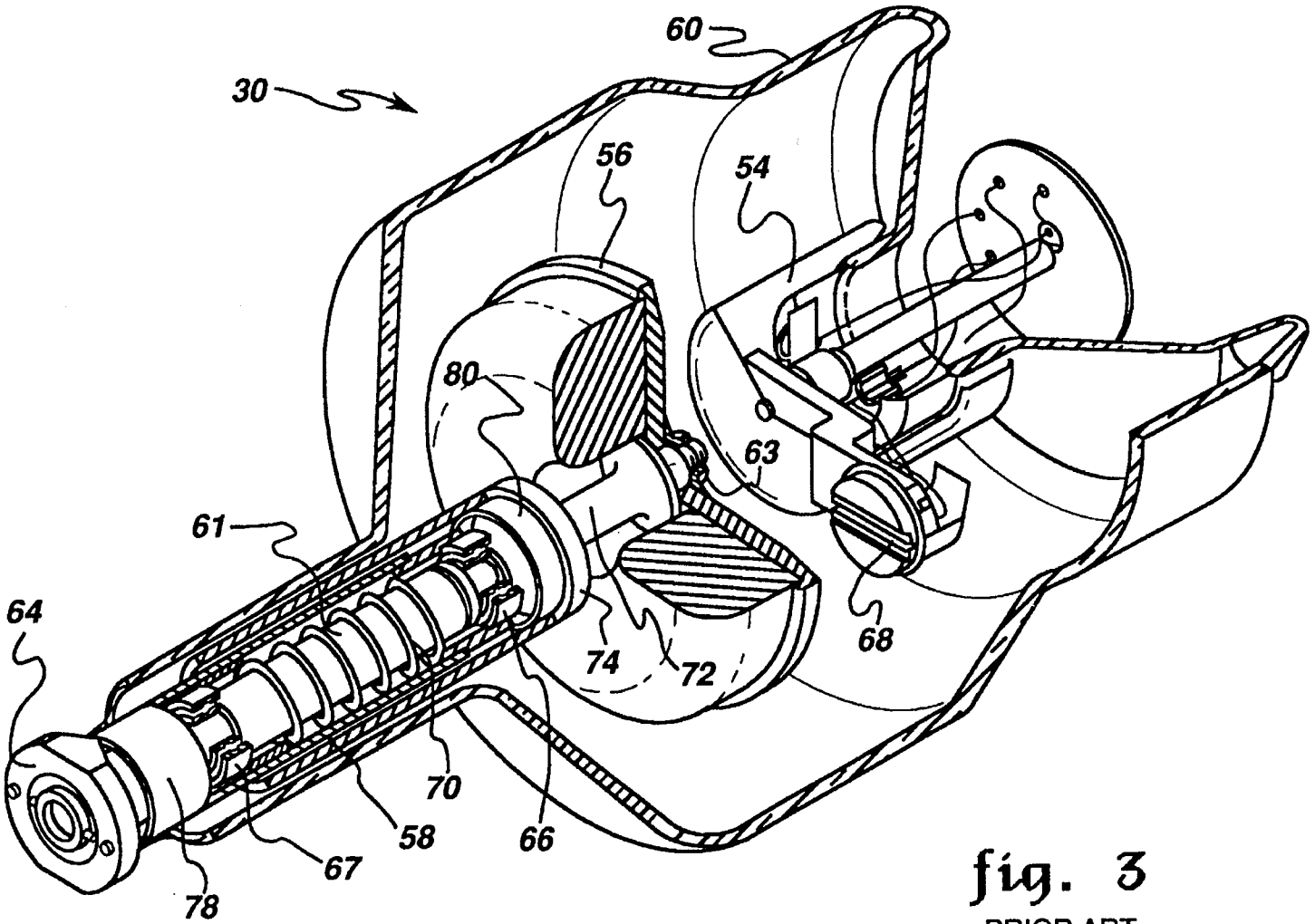
fig. 3 PRIOR ART
FIG. 3 is a partial perspective view of a representative x-ray tube with parts removed, parts in section, and parts broken away.

As shown in FIG. 3, the cathode 54 is positioned inside the glass envelope 60. As is well known, inside the glass envelope there is a vacuum of about $10^{-5}$ to about $10^{-9}$ torr. The electricity generates x-rays that are aimed from the cathode filament 68 to the anode target or the top of the target disc 56. The target disc is conventionally connected to a rotating shaft 61 at one end by a Belleville nut 63 and by another nut at the other end 64. A front bearing 66 and a rear bearing 68 are operatively positioned on the shaft 61 and are held in position in a conventional manner. The bearings 66 and 68 are usually lubricated and are susceptible to failure at high operating temperatures.

A preload spring 70 is positioned about the shaft 61 between the bearings 66, 68 for maintaining load on the bearings during expansion and contraction of the anode assembly. A rotor stud 72 is utilized to space the end of the rotor most proximate the target 56 from the rotor hub 74. The bearings, both front 66 and rear 68, are held in place by bearing retainers 78 and 80. The rotor assembly also includes a stem ring 82 and a stem 84 all of which help to provide for the rotation of the rotor 58 with the target 56.

The temperature in the area of the filament 69 can get as high as about 2500° C. Other temperatures include about 1100° C. near the center of the rotating target 56, which rotates at about 10,000 rpm. Temperatures of the focal spot on the target 56 can approximate 3200° C. and temperatures on the outside edge of the rotating target 56 approach about 1300° C. The temperature in the area of the rotor hub 74 approaches 700° C. and of the front bearing approaches 450° C. maximum. Obviously, as one moves from the target 56 to the rotor 58 and stator 43, the temperature appears to decrease.

Figure 4:
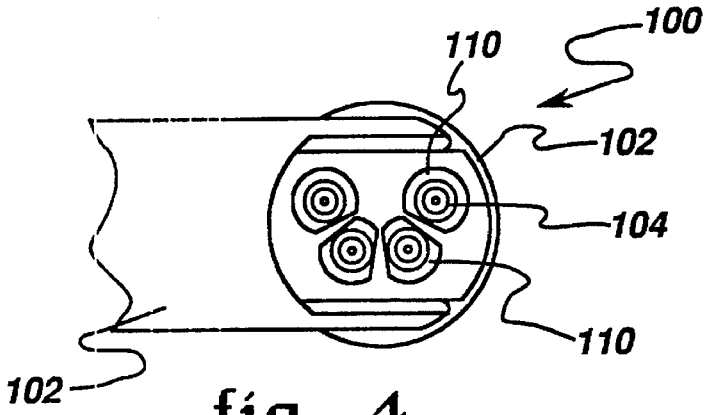
fig. 4 PRIOR ART
FIGS. 4 is a plan view of a prior art embodiment of filament(s) assembled in the cathode cup of an x-ray tube.
Figure 5:
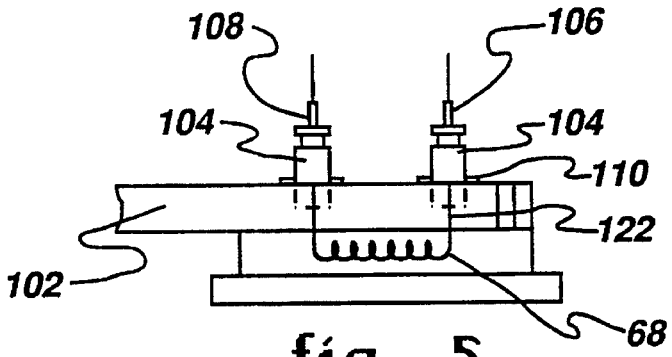
fig. 5 PRIOR ART
FIG. 5 is a side view of a prior art filament assembled in a cathode cup similar to that of FIG. 4.

Referring now to FIGS. 4 and 5, a representative prior art cathode cup for having filament(s) therein in accordance with prior practices, generally designated by the reference numeral 100, is shown. The cathode cup filament assembly 100 comprises a cup member 102, preferably made of a metallic material and more preferably made of nickel or other similar material having a high melting temperature and good heat transfer properties like nickel, individual insulator members 104 preferably made of alumina, operatively positioned in apertures formed in the cup member 102, by conventional means such as by drilling, for receiving the individual insulator member 104 which house conductive rods 106, 108 (see FIG. 5). The rods 106, 108 are preferably made of Kovar and could be made from a material chosen from the group comprising: stainless steel or other rigid conductive material.

Each of the individual insulators 104 includes a ceramic tube with a metal to ceramic seal formed to hold the tube as well as a flange 110 to the outside of the ceramic tube. The flange 110 which serves as the means for connecting the insulator to the cathode cup, is made of a metal compatible with the insulator for connecting the insulator to the flange and for connecting the flange to the cathode cup. Once the insulator 104 was positioned in the cup 102, each flange 110 was spot welded to the cathode cup 102. As is shown in FIGS. 4 and 5, a single filament cathode has two insulators 104, a two filament cathode has four insulators 104 and a three filament cathode would have six insulators 104.

During the prior method of assembling the filament into the cathode cup 102, the individual insulators 104 were placed one at a time in apertures in the cup 102 and were then welded. The four and six insulator units require that all the flanges 110 be cut or trimmed so that the flanges 110 fit in the space provided. This cutting process requires careful and often tedious work on the part of an operator in order to get the flanges 110 in proper position and evenly connected to the cathode cup 102 so that the flanges 110 are straight and parallel. Since the insulator 104 functions to hold the filaments 120, it is important that the insulator be located straight and parallel relative to each other so that filaments installed therein have straight and parallel legs. Unless the insulators 104 are assembled, straight and parallel in the cathode cup 102, the problem of filament misalignment may result, especially if the individual insulators 104 did not hold the filament legs 122 properly.

After assembly, during one prior art manufacturing process, the filament 68 was positioned in the cathode cup 102 and then heated (flashed) to about 2800° C. It was during the heating "flash" step to 2800° C. that caused the coiled tungsten filaments to move out of alignment in the stator cup and to sag. Such a misaligned or sagged filament would result in an x-ray tube that produced out of focus x-rays and/or x-rays of an area that was outside the area expected or aimed. Also, such misalignment by as little as two (2) mils, caused overheating of the filament which resulted in tube failure, i.e., not producing a good quality x-ray. Another result of filament misalignment was filament shorting, which also resulted in poor quality x-rays.

Figure 6:
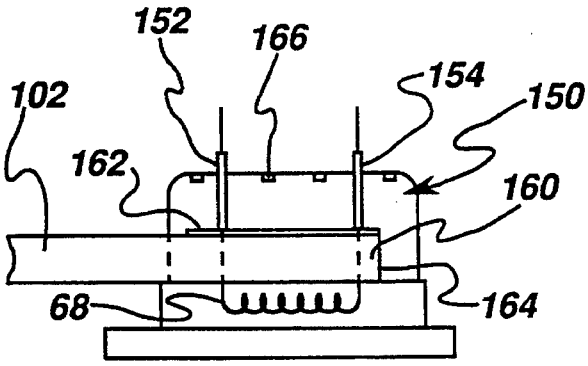
FIG. 6 is a side view of the filament assembly in the cathode and of the present invention.
Figure 7:
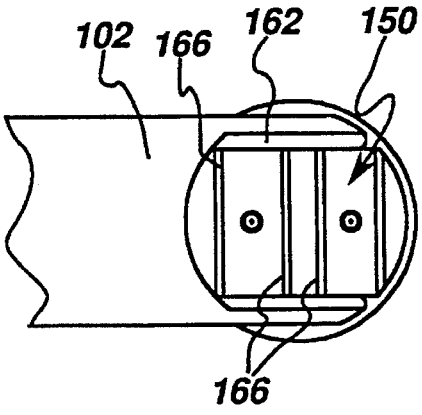
FIG. 7 is a plan view of the assembly of FIG. 6.

FIGS. 6 and 7, illustrate a representative solid insulator member 150 having tubes 152, 154, preferably made of Kovar, operatively positioned therein, such as by sealing them in place at fixed and parallel positions. While the member 150 shown has only two tubes 152, 154 for holding the legs 122 of a filament 68, four or six tubes, depending on the x-ray tube that the cathode cup is to be installed in could also be manufactured or prepared utilizing the methods of the present invention.

In one aspect of the present invention, a one-piece ceramic insulator is molded in accordance with the steps of: placing a ceramic material in a mold, the mold having means for forming at least two apertures therein; removing the ceramic material from the mold having the apertures formed therein; curing the green ceramic material; positioning filament holding tubes in the apertures formed in the ceramic block; and operatively securing the filament holding tube in position in the cured ceramic block. The filament holding tubes, are, as discussed above, preferably made of Kovar, and the means for securing the tubes in the ceramic piece is preferably a metal to ceramic seal such as brazing.

Once the insulator member 150 has been completed, it is sized so that it slides into the cathode cup frame until it contacts a portion of the cup 160 which fixes the insulator member position so that any filament legs positioned therein would be parallel and straight. The insulator member 150 includes tabs 162, preferably made of a material compatible with both the material of the insulator member and the cathode cup. The tabs 162 are means for sealing the insulator member 150 to the cathode cup to maintain the insulator member in position relative to the cathode cup 102. The mating surfaces on the insulator member and on the cathode cup, such as 164, prevent the insulator member from becoming misaligned relative to the cathode cup.

During fabrication of the ceramic insulator member, circles or grooves 166 are cast or formed to prevent solid surface coating, as done in the prior art. As is known, these circles or grooves prevent arching by disrupting the electric path along the surface of the insulator member.

The cathode cup assembly of the present invention is assembled according to the following method: providing a cathode cup member having apertures therein; providing a one-piece insulator member having apertures formed therein and a hold down tab connected thereto; operatively positioning the insulator member on the cathode cup member so that the apertures in each are aligned; operatively connecting the insulator member to the cathode cup utilizing the tab members.

After the connection of the insulator member to the cathode cup member, a filament is operatively positioned in the cathode cup by inserting the filament legs through the apertures in the cathode cup and into the apertures containing the conductive tubes in the insulator member.

Having the insulator member 150 fixed and parallel with the apertures of the cathode cup and the insulator in alignment should ensure proper filament alignment when an operator places the filament legs into the tubes in the insulator member. Additionally, the one piece ceramic insulator member having tubes formed therein would eliminate the need for the operator to cut each insulator flange to its proper size and also eliminate the setup and welding of each individual insulator to the cathode cup. With the one piece ceramic insulator member of the present invention, cutting device for trimming the insulator flange alignment dyes would be eliminated thus saving not only the operators time but also the cost of the equipment and equipment maintenance, thereby increasing manufacturing productivity.

While the methods disclosed herein constitute preferred methods of the invention, it is to be understood that the invention is not limited to these precise methods, and that changes may be made therein without departing from the scope of the invention which is defined in the appended claims.

What is claimed is:

1. A method of assembling at least one filament having legs to a cathode cup for use in an x-ray tube, the method comprising the steps of:

providing a one piece insulator structure;

providing a cathode cup structure;

operatively connecting the one piece insulator structure to the cathode cup structure;

then positioning at least one filament in the combination insulator structure/cathode cup structure; and securing the at least one filament in the combination insulator structure/cathode cup structure such that the filament is properly aligned.

2. The method of claim 1, wherein the insulator structure comprises a ceramic alumina alloy.

3. The method of claim 1, wherein the insulator structure comprises about one-hundred percent ceramic alumina material.

4. A method of assembling an insulation member on a cathode cup for use in an x-ray tube, the method comprising the steps of:

providing a cathode cup member having apertures therein;

providing a one-piece insulator member having apertures formed therein and at least one hold down tab connected thereto;

operatively positioning the insulator member on the cathode cup member so that the apertures in each are aligned; and operatively connecting the insulator member to the cathode cup utilizing the at least one tab.

5. The method of claim 4 further comprising the step of:

operatively positioning a filament in the cathode cup by inserting the filament legs through the apertures in the cathode cup and into conductive tubes operatively positioned in the insulator member.

* * * * *